US005762730A

United States Patent [19]

Pieber

[11] Patent Number: 5,762,730

[45] Date of Patent: Jun. 9, 1998

[54] METHOD FOR MACHINING STEEL EDGES FOR SKIS AND THE LIKE

[75] Inventor: Alois Pieber, Ried, Austria

[73] Assignee: Fischer Gesellschaft m.b.H., Ried im Innkreis, Austria

[21] Appl. No.: 565,165

[22] Filed: Nov. 30, 1995

[30] Foreign Application Priority Data

Dec. 23, 1994 [AT] Austria ..... 2405/94

[51] Int. Cl.[6] ..... C21D 1/04

[52] U.S. Cl. ..... 148/565; 148/903; 219/121.59

[58] Field of Search ..... 148/565, 660, 148/903; 219/121.59

[56] References Cited

U.S. PATENT DOCUMENTS

| | | | |
|---|---|---|---|
| 4,317,984 | 3/1982 | Fridlyand | 219/121 PU |
| 4,595,817 | 6/1986 | Bobrov et al. | 219/121 PY |
| 4,764,656 | 8/1988 | Browning | 219/121.44 |
| 5,144,109 | 9/1992 | Klingel | 219/121.85 |
| 5,204,987 | 4/1993 | Klingel | 219/121.6 |
| 5,360,495 | 11/1994 | Schuler et al. | 148/565 |

FOREIGN PATENT DOCUMENTS

| | | |
|---|---|---|
| 286152 | 11/1970 | Austria . |
| 307951 | 2/1971 | Austria . |
| 2016279 | 8/1968 | France . |
| 2204270 | 4/1976 | Germany . |
| 2842407 | 4/1980 | Germany . |

OTHER PUBLICATIONS

Goodwin, D. et al, "Surface heat treatment using a plasma torch with a magnetically traversed arc", Advances in Welding Processes, vol. 1, 1978, pp. 181–183.

*Primary Examiner*—Sikyin Ip

*Attorney, Agent, or Firm*—Jacobson, Price, Holman & Stern, PLLC

[57] ABSTRACT

Method for machining steel edges for skis or the like, the steel edge being at least partly rapidly heated, then rapidly cooled again and consequently hardened with the aid of a plasma jet. In order to provide a method, which in economic manner can ensure the uniform and precisely defined hardening of steel edges of skis and the like in a randomly long longitudinal portion and in which simultaneously the energy can be applied in a more gentle and planned manner and a less complicated guidance of the plasma jet is rendered possible, an electric arc is produced between the cathode and the anode of the plasma head and a gas flow is passed through said arc and the anode of the plasma head, accompanied by the production of a plasma jet and the steel edge to be hardened is electrically connected as an anode in synchronized manner with the plasma head anode, i.e. is also polarized as an anode, or alternatively only the steel edge is polarized as an anode, an electric arc is produced between the steel edge and the cathode of a plasma head and a gas is passed through said arc, accompanied by the production of a plasma jet directed onto the steel edge.

10 Claims, 9 Drawing Sheets

METHOD FOR MACHINING STEEL EDGES FOR SKIS AND THE LIKE

BACKGROUND OF THE INVENTION

1. Field of the Invention

The invention relates to a method for machining or working steel edges for skis and the like, in which the steel edge at least partially and preferably at least in the vicinity of the edge outwardly bounding the outsole of the ski, i.e. the outer, lower corner of the steel edge, or entirely undergoes rapid heating with the aid of a plasma jet, is then rapidly cooled again and consequently hardened.

2. Description of the Prior Art

In order to improve the wear characteristics and in particular the cutting quality of steel edges, particularly of skis, it will be desirable to have a very high material hardness. In the case of a corresponding hardening of the entire section forming the steel edge, its elasticity would be simultaneously inadmissibly impaired. Thus, it is proposed in Austrian patent 286 152 to provide the ski with steel edges, which are only partly hardened, namely at the location of the greatest exposure to wear, i.e. the lower edge which is at the outside with respect to the bearing surface. This transformation of the material of the steel edge into a fine-grain, extremely hard and tough martensitic structure takes place by rapid heating, rapid quenching and subsequent additional energy supply. The energy source indicated for the rapid heating of the material is a plasma torch, but no information is given on the way in which the plasma jet is to be produced or how a uniform and/or precisely defined hardening can be obtained in a precisely defined area of the steel edge. Naturally such a hardening is also advantageously usable for the edges of toboggans, bobsleighs, skates, etc.

The known application of conventional plasma torches to the hardening of cutting edges of saws, knives or punching tools, as is e.g. described in Austrian patent 392 483, where considerable effort and expenditure is required for obtaining a very uniform plasma jet from the plasma torch and for the precise guidance of the jet from the plasma head along the cutting edge area to be hardened, provides no information in connection with use in sports equipment. When using a plasma jet for hardening saw blades and the like, as a result of the very large steel masses of these articles no embrittlement phenomena need be feared, because with such large masses there is a very good heat dissipatioin from the location to be hardened up to the remaining body. These applications give no information concerning the possibility of hardening e.g. steel edges for skis, where as a result of the small steel masses in conventional plasma jet processes and equipment, as a result of the energy injection the heat action would lead to the embrittlement and also damage of the components surrounding the edge. The aforementioned Austrian patent 286 152 also provides no information on this problem and any solution to the same.

SUMMARY OF THE INVENTION

The problem of the present invention is consequently to give a method, which in an economic way reliably ensures a uniform or precisely defined, partial hardening of steel edges or skis and the like in a randomly long longitudinal portion by means of a plasma jet and in which it must in particular be ensured that the energy injection takes place in a gentle, planned manner, so as to avoid problems due to inadmissible embrittlement and damage to the material surrounding the steel edges during hardening of edges already fitted to the ski due to excessive and too hard energy injection. Simultaneously it must be possible to obtain a simpler and less complicated guidance of the plasma jet.

Further problems are a precisely defined, partially or wholly hardened steel edge, a ski provided with such a steel edge, and a plasma head or a means for producing a precisely defined, partly hardened steel edge.

According to the invention, for solving the first problem, an electric arc is produced between the cathode and the anode of the plasma head and a gas flow is passed through this arc and the anode of the plasma head, accompanied by the formation of a plasma jet, and the steel edge to be hardened is electrically connected as an anode like the plasma head anode, i.e. is also polarized as an anode. This feature greatly facilitates the precise guidance of the plasma jet along the steel edge, because between the cathode in the plasma head and the steel edge as the anode, the plasma jet is automatically attracted to the steel edge. This is in turn an obvious prerequisite for a precisely defined power introduction into a precisely predeterminable area of the steel edge. Thus, the heating rate and, as a function of the material, the area covered by the hardening can be precisely defined. In addition, the current intensity, which essentially determines the energy content of the plasma jet and consequently the quality of the hardening process, is significantly reduced and therefore the energy or power can be brought into the steel edge in a gentler manner. This is also an important prerequisite for the hardenability of steel edges already fitted to the ski. It must then be ensured that the heating of the steel edge material is not excessive, so as there is no heating of the ski material adjacent thereto to above a certain minimum temperature. The material of the ski would be damaged, connections would be loosened or detached and the adhesive, e.g. for fixing the steel edges in the ski, would be dissolved, etc. As a result of the treatment according to the invention with a jet impacting with a precisely defined energy at all times, the material heating can be precisely controlled and inadmissible overheating or local burning by overheating can be avoided.

According to a further feature of the invention, alternately thereto, only the steel edge is polarized as an anode, an electric arc is produced between the steel edge and the cathode of a plasma head and a gas is passed through said arc, accompanied by the production of a plasma jet directed onto the steel edge. Thus, whilst maintaining the advantages of a gentler and more planned power introduction, this considerably simplifies the construction of the plasma head.

If the plasma head and the steel edge are moved relative to one another in the longitudinal direction of the steel edge and the plasma jet, at least over a partial area of the steel edge length, always has the same energy, this preferably taking place by supplying the steel edge-plasma head system with precisely the same current intensity, then a uniform, exactly defined hardening is ensured over the entire length of the covered longitudinal area of the steel edge. This ensures that during any remachining of the steel edge, e.g. with a uniform abrasive machining, along the entire hardened length of the steel edge the same material characteristics are present and there are no undesired hardened and unhardened portions in a non-predeterminable order. with this feature that the plasma jet always has precisely the same energy is associated the fact that at each point of the plasma jet and at all times always the same temperature prevails, i.e. the temperature distribution in the plasma jet remains constant.

However, if a precisely defined distribution of hardened and unhardened areas or areas with different characteristic hardening, both with respect to the material hardness and the depth or volume of the hardened area, is desired, this can advantageously be achieved in that the plasma head and the steel edge are moved relative to one another in the longitudinal direction of the steel edge and over at least a partial area of the steel edge length, the plasma jet has a preferably regularly variable energy and this is preferably obtained by a regular modification of the current intensity supplied to the steel edge-plasma head system. Variable energy means that the temperature at each point of the plasma jet changes equidirectionally and in a precisely forecastable or determinable manner.

In order in a simple and time-saving manner to be able to cover a maximum area of wear-stressed locations, the plasma jet is simultaneously directed onto two outsides of the steel edge and the jet axis is oriented preferably in inclined manner on both outsides, particularly in a range of 25° about the angular symmetry line and specifically precisely in the angular symmetry lines. As a function of the angle of the jet and/or its upward or downward parallel displacement with respect to the axis of symmetry of the outer edge to be hardened, it is possible to attain a symmetrical or asymmetrical hardness zone and consequently an adaptation to special wear situations or uses. A symmetrical hardness zone of the outer edge, whose shape, even in the case of remachining remains as long as possible, can be produced with a plasma jet orientation preferably precisely coinciding with the axis of symmetry of the outer edge.

According to a particularly advantageous variant of the method according to the invention, the steel edge is firstly fitted to the ski, then an electric arc is produced between the cathode and the anode of the plasma head and a gas flow is passed through this arc and the anode of the plasma head, accompanied by the production of a plasma jet and the steel edge to be hardened is electrically connected as an anode in synchronized manner with the plasma head anode, i.e. is also polarized as an anode, the area around the plasma jet impact area being cooled in such a way that in the transition area between the steel edge and the ski preferably the dissolving temperature of the adhesive for fastening the steel edge to the ski body is not exceeded. The hardening of the steel edges can constitute the final operation of ski manufacture, because there is no impairing of other ski components as a result of the hardening method according to the invention and consequently no subsequent treatment stages are required. Thus, the already fitted steel edges are not exposed to mechanical stresses, there is no risk of damage and no functional impairment, as is the case when hardening the edges prior to the fitting to the ski. The heating of the material of the ski areas surrounding the steel edge, as a result of the heat dissipation contributes to the self-quenching of the area heated by the energy beam and consequently to the hardening process, so that less heat energy has to be removed in some other more complicated and costly manner. It must be ensured that the temperature does not rise too high, so as to dissolve or disintegrate the adhesive used for fixing the steel edges.

In order to be able to cover a larger area of the steel edges with a given plasma jet production device, according to another feature of the invention the plasma jet impact area is extended in the longitudinal direction of the steel edge at least in a virtual manner and preferably by electromagnetic deflection of the plasma jet. This means that it is not the plasma jet diameter which is increased, which might destroy the parameters vital for a uniform temperature and power distribution, but through a winding guidance of the impact point with high frequency or a "vibratory movement" of the impact point about a central axis during the relative movement of plasma head and steel edge, a larger area is covered than corresponds to the plasma jet cross-section. The virtual expansion or widening can take place in one or any random direction perpendicular to the plasma jet axis. This offers the possibility of covering and hardening a larger area extending from the lower, outer steel edge to the two outsides through the virtual widening of the plasma jet and consequently e.g. the remachining is facilitated by allowing a uniform removal of the edge material. This variant also offers the advantage of slowing down the very rapid heating of the material through the plasma jet due to the energy distribution and consequently, if necessary, obtaining a reduced hardness than would correspond to the plasma jet energy. As generally the area available for the virtual widening on the outer steel edges is limited and if only a hardening in a narrow area around the wear-prone edge is desired, widening takes place in the longitudinal direction of the steel edge.

Apart from virtual widening, which is somewhat more complicated and costly due to the equipment required, according to another feature of the invention it is possible to widen the physical cross-section of the actual plasma jet, preferably in the longitudinal direction of the steel edge. This allows a distribution of the injected energy over a larger surface area, but still in a very narrow area around the actual edge of the steel edge to be hardened.

A particularly important feature for the uniformity of the energy delivery from the plasma head is that the gas flow round the plasma head cathode is kept laminar. In the case of a laminar flow the temperature distribution in the plasma jet is particularly accurately defined at all points in the desired way. However, it also leads to the advantage that the ignition of the plasma head can take place by a sinusoidal pulse and therefore with little or only simple shielding the plasma head does not influence surrounding electronic components. This is particularly significant in the automated performance of the method according to the invention using industrial robots or similar, microprocessor-controlled means.

A further object of the invention is a steel edge for a ski or the like, which is partly hardened according to a method described in the preceding paragraph. Through the use of the plasma jet according to the invention for hardening, it is possible in very simple, economic and reliable manner to obtain a deeply extending hardening of the steel edge, particularly in the plane of symmetry of the wear-prone outer edge, so that a cross-sectionally, substantially triangular hardness zone is obtained. Other hardening methods, such as e.g. when using lasers, do not lead to such a deep penetration, so that there is a cross-sectionally, roughly L-shaped hardness zone extending in only a limited depth along the outsides of the steel edge.

The invention also relates to a steel edge for a ski or the like, which is hardened at least partly and possibly also wholly by a method according to one of the preceding paragraphs.

The invention also relates to a ski, provided with at least one, at least partly and possibly also wholly hardened steel edge, produced by a method described in one of the preceding paragraphs.

The edges hardened according to the invention can also be used for bobsleighs, toboggans, skates, etc. or steel running edges thereon can be hardened by means of the method according to the invention.

The invention also relates to a plasma head for hardening edges in steel materials, particularly for performing the method according to one of the preceding paragraphs, having a casing, devices for supplying a gas and a preferably round rod-shaped cathode around which the gas flows. According to the invention, this plasma head is characterized by a guide piece for the gas flow or the plasma jet, which can be switched as an anode and surrounds one end of the cathode and which is provided with an opening for the exit of the plasma jet. Thus a much simpler plasma head construction can be obtained, because all conventional high voltage insulating constructions between the cathode and the anode can be made smaller due to the lower current intensity required for hardening purposes.

According to another feature of the invention a preferably insulating material bush, provided with radial bores, is provided round the cathode for supplying the gas, said bush leaving free an annular clearance round the cathode. Together with the outside of the cathode the inside of the bush defines an annular entrance and uniformizing area for the plasma torch gas, which favours the setting of a laminar flow, which is important for the uniformity of the plasma jet.

Particularly favourable results are obtained if, according to an advantageous feature of the invention, the annular clearance left free between the bush and the cathode has a height to width ratio of 2:1.

According to a further feature of the invention the plasma head is characterized by a tungsten-zirconium cathode. This material ensures a uniform discharge between the cathode and the anode and also leads to a uniform temperature and energy distribution in the plasma jet passing out.

With respect to the laminar nature of the gas flow, it has proved particularly advantageous if at least one end of the cathode tapers with angle between 20° and 90°, preferably 60°. This angle, which is measured between the symmetrically facing sides of the cathode, ensures a gentle tapering of the cathode towards the tip, so that the gas flow remains laminar and the plasma jet uniform.

According to another feature of the invention, at least one end of the cathode is round conical with a vertex angle between 45° and 90°, preferably 60°. This cathode shape gives a laminar and very uniform, concentrated plasma jet. Advantageously the cathode ends in pointed form, which ensures an optimum emission behaviour for the charged carriers and the maximum energy density, accompanied by a limited influencing of the laminar flow characteristic, i.e. no breaking off of the flow.

According to another embodiment the cathode ends in truncated form, preferably in a planar surface perpendicular to the cathode axis. This cathode end construction permits an optimum breaking off of the gas flow at the end of the cathode with a minimum influencing of the laminar flow characteristic, but with still an adequately good emission behaviour for the charge carriers.

Preferably the opening in the guide piece is in the form of a round hole, which is preferably precisely circular. This ensures the best possible focussing on a very small area of the edge to be hardened.

According to another feature of the invention, the opening in the guide piece is shaped like a slot and preferably the longer diameter is oriented in the longitudinal direction of the steel edge. This shape of the exit opening for the plasma jet from the plasma head brings about a physical widening of the plasma jet in the direction of the longer diameter and consequently a distribution of the energy over a larger area of the steel edge and preferably over a longitudinal area thereof. This leads to a slower heating of the material which, if desired, leads to a reduced hardness of the partly hardened part of the steel edge.

Alternatively or additionally to the aforementioned feature, for obtaining the same effects, according to a further feature of the invention devices are provided for the electromagnetic deflection of the plasma jet in the vicinity of the plasma jet exit opening.

The invention also relates to an apparatus for hardening the edges of steel materials, particularly for performing the method according to the invention, having at least one and preferably two plasma heads, as described in one of the preceding paragraphs, as well as devices for guiding the or each plasma edge and the steel edge or the ski provided with a steel edge to be hardened relative to one another in the longitudinal direction of the steel edge, as well as with devices for introducing power into the steel edge.

According to another feature of the invention, the apparatus is advantageously characterized by preferably liquid-cooled cooling bodies, preferably made from copper, which are guided at a distance from the steel edge or the ski body of preferably 0.2 to 0.3 mm. The cooling bodies dissipate the heat quantity, which can no longer be absorbed by the ski body, without exceeding a predetermined temperature, preferably the dissolving temperature of the adhesive fixing the steel edges. The most favourable solution for the cooling fluid is water at max approximately 20° C. and the most advantageous material for manufacturing the cooling bodies is copper in order to rapidly dissipate large heat quantities. In order to avoid damage to the surface of the steel edges and/or the ski, the cooling bodies are not directly applied to the steel edge or the ski surface and guided along the same in contact therewith and are instead guided at a limited distance from the steel edge and/or the ski.

A protection of the area of the object alongside the steel edge area to be hardened by further focussing or covering with respect to the plasma jet can be brought about if the cooling bodies have a passage slot for the gas flow or the plasma jet preferably oriented in the direction of the longitudinal axis of the steel edge to be hardened.

DESCRIPTION OF THE PREFERRED EMBODIMENTS

Figure 1:
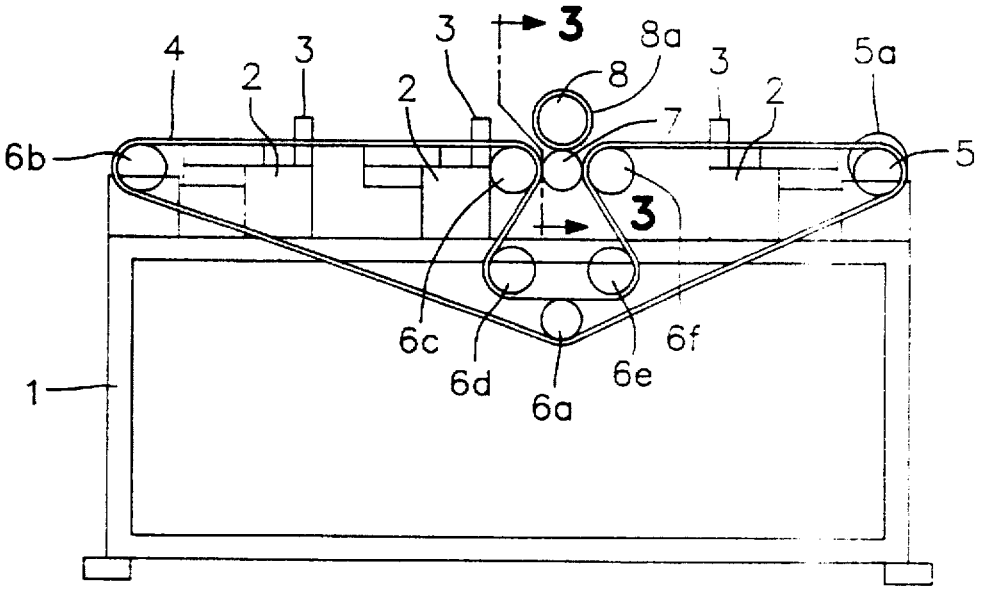
FIG. 1 is a side elevational view of an apparatus for hardening steel edges already fitted to a ski in accordance with the present invention in which the guiding devices and plasma jet producing devices have been omitted.
Figure 2:
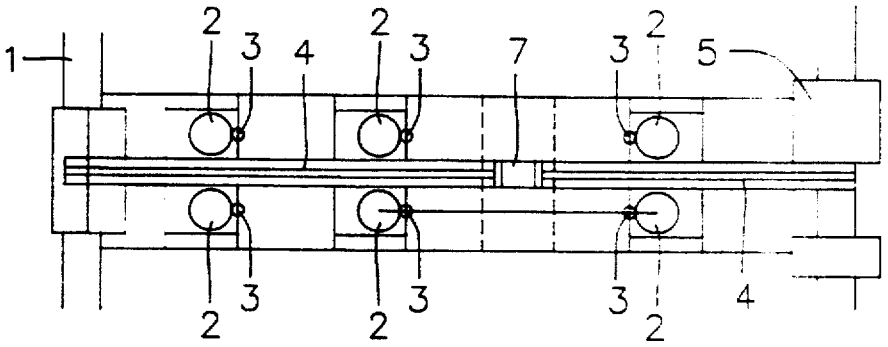
FIG. 2 is a plan view of the apparatus in FIG. 1.

On a frame 1 are provided three guide devices 2 for the not shown ski, which precisely ensure, i.e. to within a tenth of a millimetre and in per se known, preferably automatable manner the lateral guidance of the ski. On either side of the conveying path of the ski are provided guide pulleys 3 settable for this purpose. The ski to be treated is moved through the installation by means of a conveyor belt 4, which is set in motion by a driving pulley 5*a* driven by an exactly regulatable motor 5. The conveyor belt 4 runs over the deflecting pulleys 6*a* to 6*f* and is constructed in such a way that by friction a frictional connection can be obtained preferably with the ski tread or bearing surface.

For the precise height guidance of the ski, i.e. perpendicular to the plane, within which the ski is guided by the guide pulleys 3, the two rollers 7 and 8 are provided. The lower bearing roller 7, on which the ski engages with the bearing surface, is freely rotatably mounted on a fixed or at least precisely fixable spindle and is made from a very hard material, preferably steel. By means of the top pressing roller 8, which is provided with a relatively soft, elastic circumferential covering 8*a*, the ski is pressed against the lower bearing roller 7 and in particular it is necessary to overcome the pretension of the ski in its central area, which gives rise to the upward curvature of the ski between its front and rear bearing line. Simultaneously with the pressing on the bearing roller 7, due to the pretension a pressure of the ski is exerted on the conveyor belt 4 and said pressure contributes to the frictional connection based on the friction between the bearing surface and the conveyor belt 4. The pressing roller 8 is vertically adjustable and resiliently movably guided perpendicular to the ski in order to allow the unhindered passage of the blade of the ski and its insertion or removal with respect to the apparatus.

Figure 3:
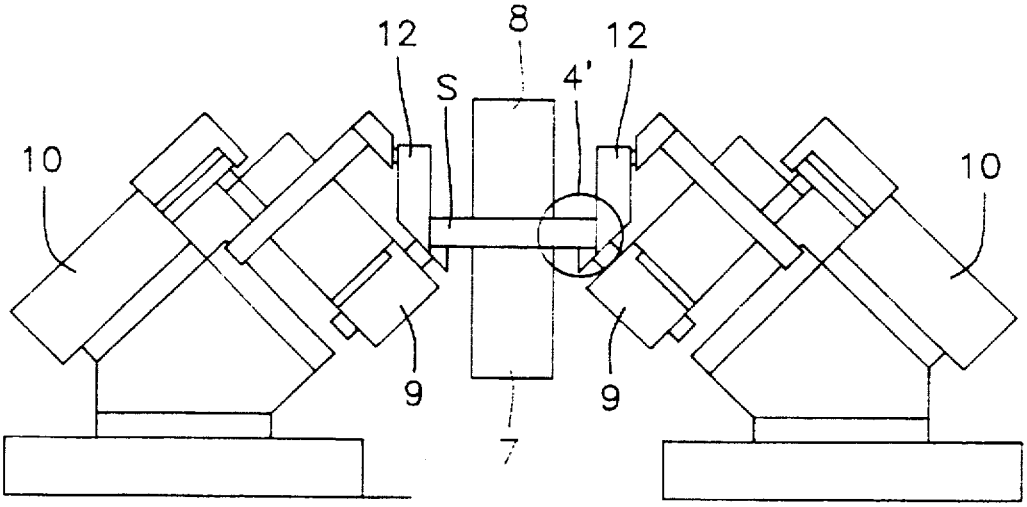
FIG. 3 is a transverse, vertical sectional view of the apparatus taken generally along section line 3—3 on FIG. 1 with a plasma head and positioning devices on either side of the ski.

In FIG. 3 the ski is designated S and it is already provided with the steel edges K to be hardened. This is particularly advantageous, because during the fitting of the steel edges K to the ski S an already performed hardening would lead to a more difficult handling of the edges K and there would be a risk of damage (breakage) of said edges K. The ski S is pressed by the pressing roller 8 on the bearing roller 7. On either side of the ski S is provided a device 9 for producing the plasma jet for heating the particular steel edge K, because this ensures a faster (because taking place simultaneously on both sides) and therefore more economic working than the equally possible arrangement of only one device 9 on one side of the ski S. The devices 9 are carried by support structures 10, e.g. microprocessor-controlled robot arms, said support structures 10, as is symbolized by the arrows in the lower part, advantageously being mounted in controllably movable manner parallel to the axis of the bearing roller 7. This mobility is necessary in order to keep the device 9 in simple manner, because only one movement in one direction is needed, with precisely the same spacing from the steel edge K, no matter how the ski S is shaped. Thus, the plasma head 9 can follow up any random necking down or other shape of the ski S. For the plasma head described hereinafter preferably the following values are used for obtaining favourable results: distance between the device 9, here specifically the plasma jet outlet nozzle, to the steel edge K: 1 to 10 mm; relative speed of the steel edge K and device 9 in the longitudinal direction f the edge K: 2 to 15, preferably 9 m/min. With these parameters for CK steel values of over 50 Rockwell can be obtained and for the steel edges of skis the values are advantageously between 55 and 70, preferably between 60 and 65 Rockwell and this can be brought about by a suitable matching of all the method parameters.

The control of the described movement takes place by not shown contact rollers, which are also provided on each support structure 10, said contact rollers being monitored by suitable sensors and in which the support structures 10 are so controlled that the contact rollers always engage with the same pressure on the steel edge 4.

Figure 12A:
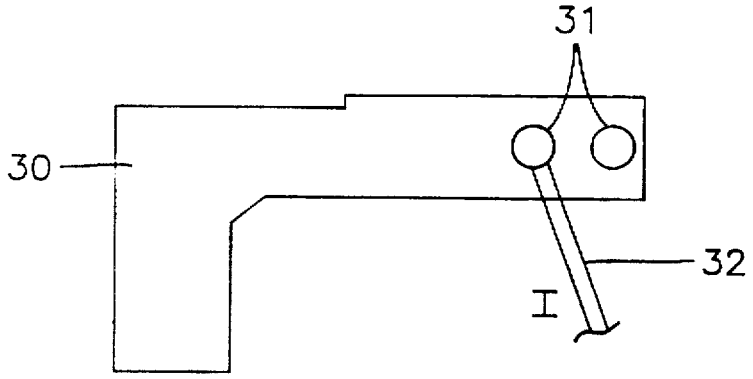
FIG. 12*a* is an elevational view of the device for introducing power into the steel edge of the ski.
Figure 12B:
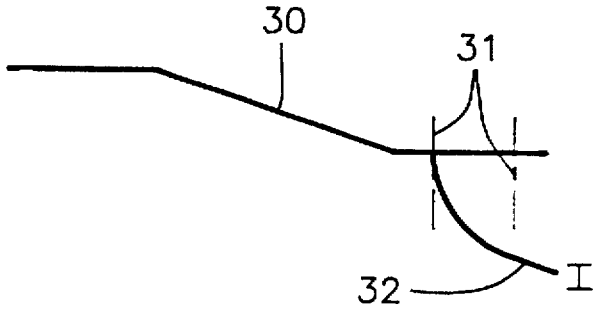
FIG. 12*b* is a schematic illustration of the orientation of the components of the device for introducing power into the steel edge.
Figure 12C:
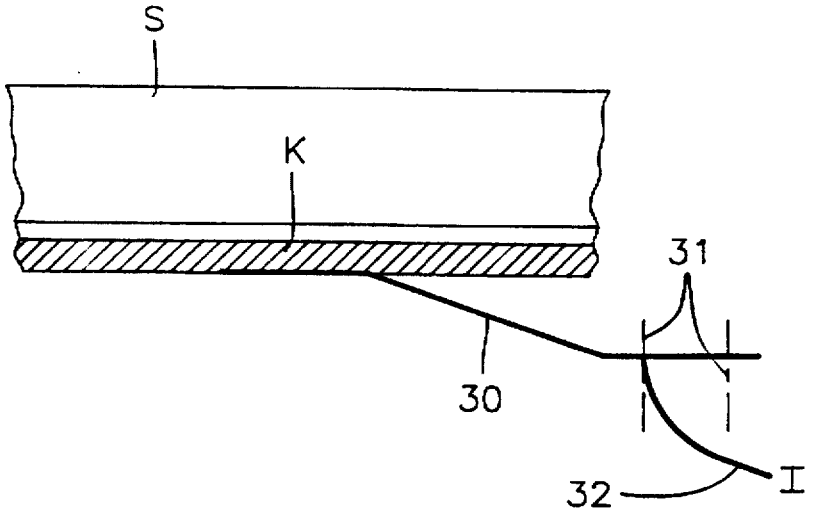
FIG. 12*c* is an enlarged detail view illustrating the device for introducing power in its working position in relation to the ski.

FIG. 3 illustrates the support structure 10 and the complete apparatus. In addition, there are devices 30 (See FIGS. 12*a* to 12*c*), which allow the power introduction into the steel edge K and its connection as an anode with respect to the cathode in the plasma head. These devices are preferably in the form of copper springs, which can be fixed e.g. by means of two screws 31 to one part of the support structure 10 and in which one of the screws 31 simultaneously serves for fitting the current lead 32 to the spring 30.

Figure 4:
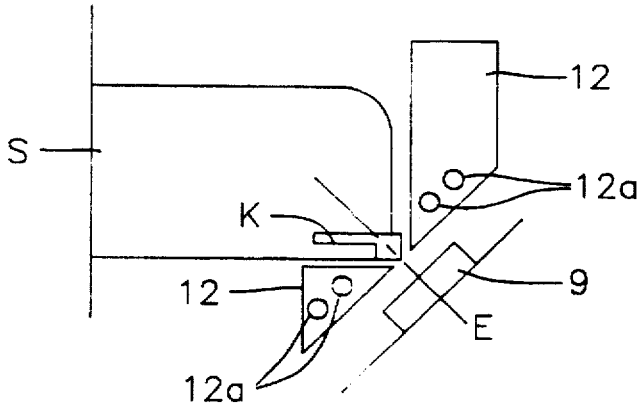
FIG. 4 is an enlarged detail view of the area indicated by reference numeral 4' in FIG. 3.

FIG. 4 shows two separate, liquid-cooled cooling bodies 12, which protects the material of the components of the ski S surrounding the edge K from excessive heating by the energy beam E of the device 9. The cooling fluid, preferably water and having a maximum temperature of approximately 20° C., flows through the passages 12*a* into the preferably copper cooling bodies 12. These cooling bodies 12 cover a longitudinal area of a few centimetres to approximately 30 cm upstream and downstream of the impact area of the energy beam E. As is clearly shown in FIG. 4, the cooling bodies 12 carried by the support structure 10 do not engage on the ski S or the edge K, but instead are spaced therefrom by preferably 0.2 to 0.3 mm, which ensures that there is no damage or deterioration of the materials e.g. through scratching, but that at the same time there is an adequate heat dissipation.

Figure 5A:
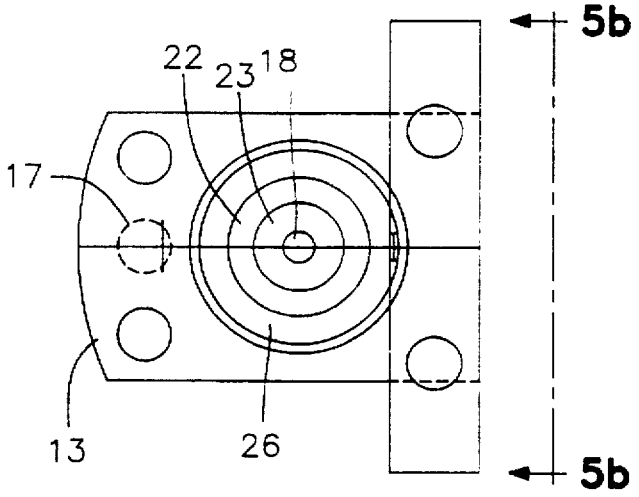
FIG. 5*a* is a plan view of a plasma head in accordance with the present invention.
Figure 5B:
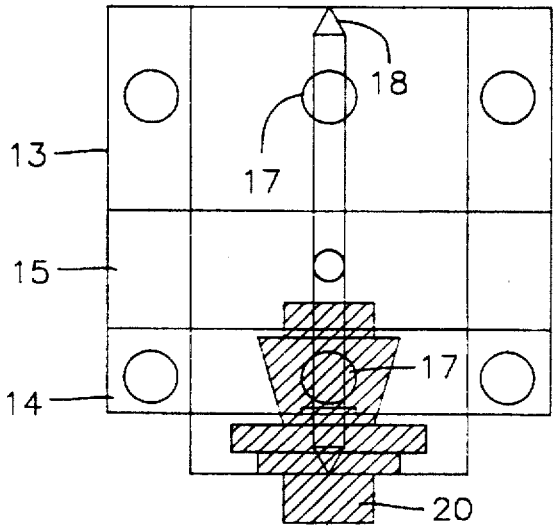
FIG. 5*b* is a side elevational view of the plasma head as viewed from reference lines 5*b*—5*b* in FIG. 5*a*.
Figure 5C:
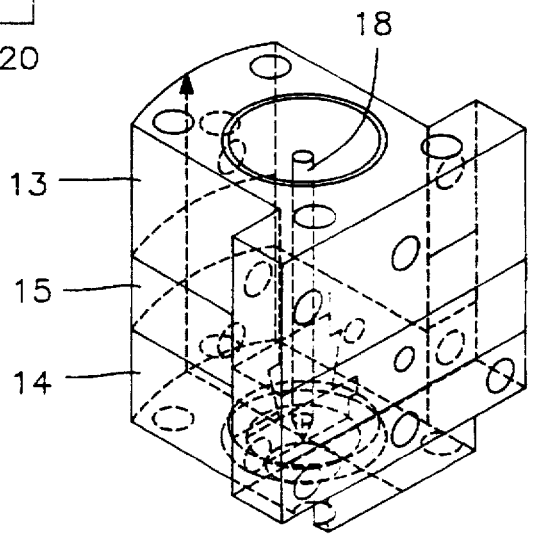
FIG. 5*c* is a perspective view of the plasma head.
Figure 6A:
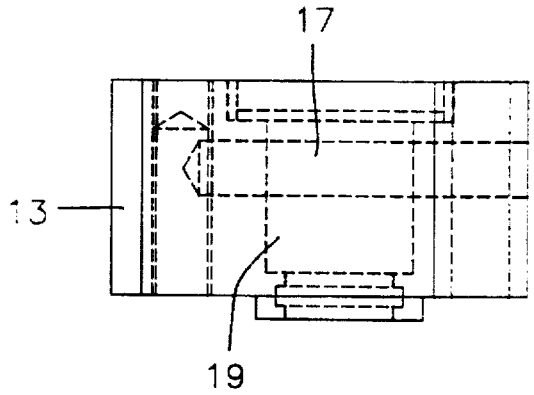
FIG. 6*a* is a side elevational view of the upper part of the plasma head.
Figure 6B:
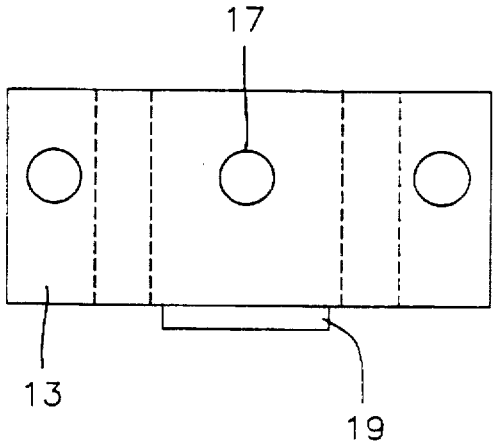
FIG. 6*b* is an end elevational view of the upper part of the plasma head.
Figure 6C:
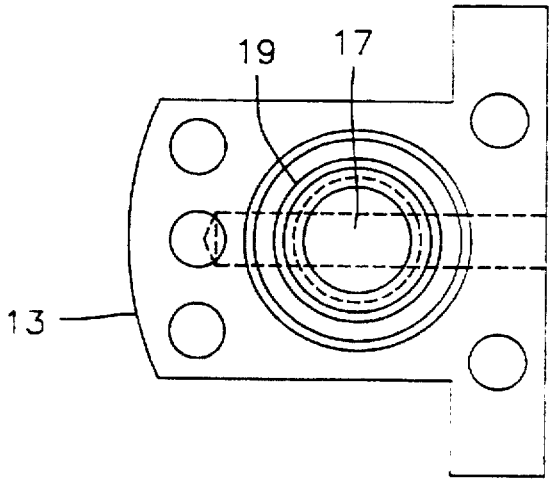
FIG. 6*c* is a top plan view of the upper part of the plasma head.
Figure 7A:
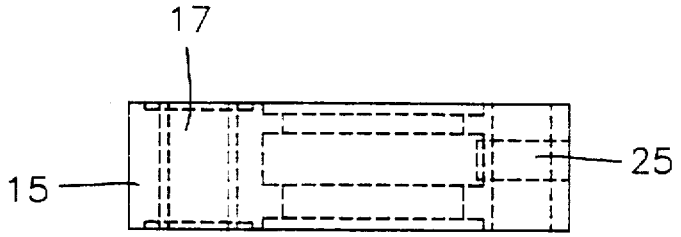
FIG. 7*a* is a side elevational view of the central part of the plasma head.
Figure 7B:
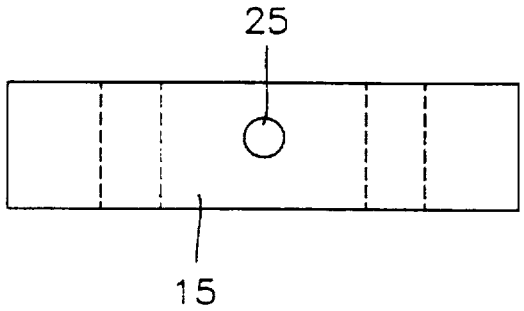
FIG. 7*b* is an end view of the central part of the plasma head.
Figure 7C:
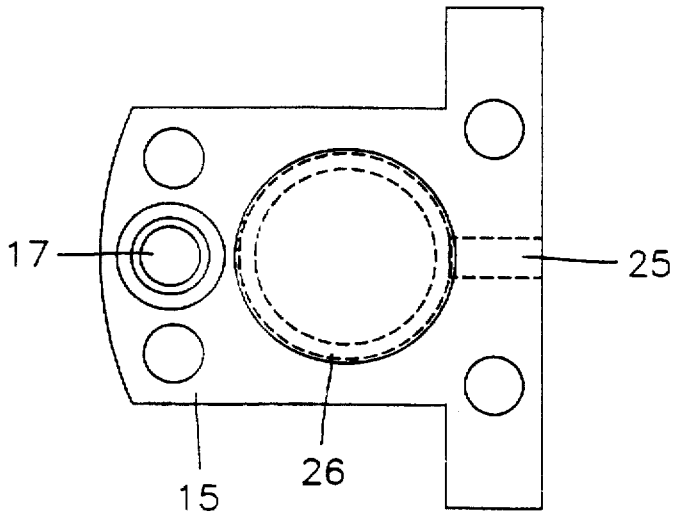
FIG. 7*c* is a top plan view of the central part of the plasma head.
Figure 8A:
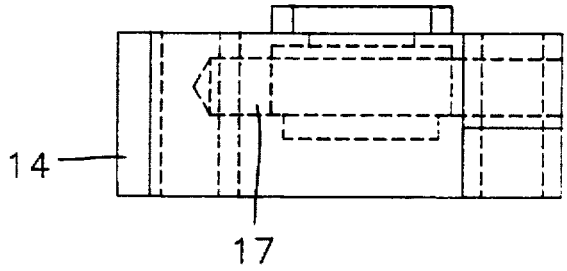
FIG. 8*a* is a side elevational view of the lower part of the plasma head.
Figure 8B:
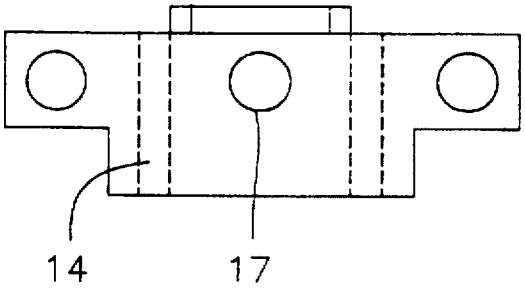
FIG. 8*b* is a side elevational view of the lower part of the plasma head.
Figure 8C:
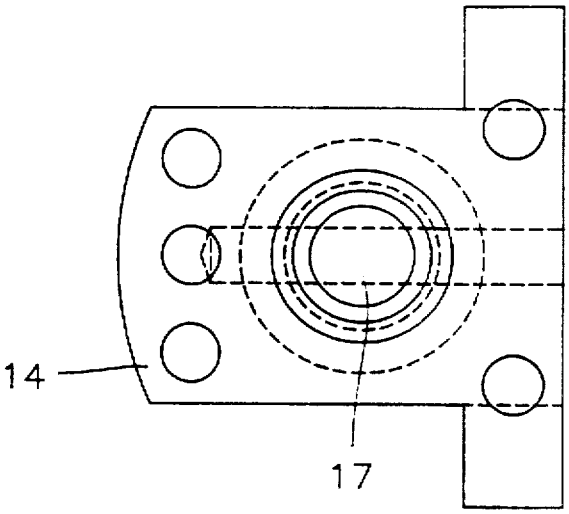
FIG. 8*c* is a top plan view of the lower part of the plasma head.

Thus, FIGS. 5a–5c shows a preferred embodiment for a plasma head as the device 9 for producing the energy beam E and is described in greater detail hereinafter.

The plasma head 9 diagrammatically shown in FIGS. 5a to 5c comprises a casing formed by an upper part 13 and a lower part 14, said parts 13 and 14 being separated from one another in electrically insulated manner by an insulating material part 15. In each case one not shown connecting element on the upper part 13 or lower part 14 is provided in the cooling ducts 17 for the supply or removal of cooling medium for the plasma head 9. In the upper part 13 can be fixed a cathode 18 in per se known, interchangeable manner in a conventional mounting support 19. In the lower part 14 is provided a guide piece 20 for the gas flow with an outlet opening for the gas to be subsequently ionized and which surrounds in spaced manner the free end of the cathode 18.

This guide piece 20 can, according to an embodiment of the plasma head 9, be constructed and connected as an anode. Due to the lower current intensities required as a result of the described method, the plasma head 9 and its insulating devices can be made smaller. However, the guide piece 20 may only be connectable as an anode, so that, after igniting the electric arc and the plasma jet E with the aid of the anodically connected guide piece 20 and subsequent depolarization of this guide piece, a plasma hardening process with the cathode 18 in the plasma head 9, neutral and only flow-guiding acting guide piece 20 and steel edge K connected as an anode can be implemented. The guide piece 20 could also be made completely neutral and without a current connection, so that even the ignition of the plasma head 9 takes place in conjunction with the steel edges K as the anode.

Between the mounting support 19 of the cathode IS and the guide piece 20 is provided, optionally substantially with the same height as the insulating material 15, a preferably insulating material bush 22, surrounding in spaced manner the cathode 18 and preferably made from a ceramic material, so that an annular space 23 is defined between the inner wall of said bush 22 and the cathode 18. On one side said space 23 is terminated by the mounting support 19 of the cathode 18, whereas on the facing side it continues in the annular clearance between the cathode 18 and the guide piece 20, as well as the outlet opening 21. Through a line 25 issuing upstream or downstream of the sectional plane into the plasma head 9, the gas to be ionized is passed into an annular clearance 26 around the bush 22 and through not shown radial bores in said bush 22 into the inlet and uniformizing space 23.

The gas to be ionized is e.g. helium or nitrogen, but preferably argon in a quantity of 0.5 to 5 l/min, argon leading to a particularly stable plasma with a simultaneous protective gas action.

Figure 9:
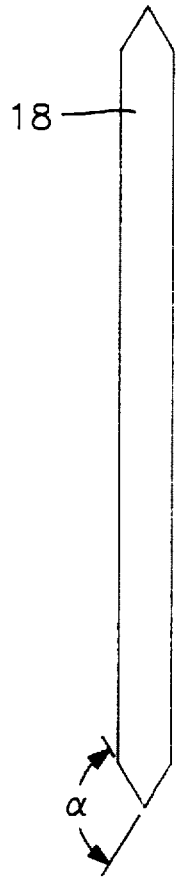
FIG. 9 is a side elevational view of the plasma head cathode.

For the uniform energy of the plasma jet a laminar gas flow along the cathode 18 is particularly important. Thus, by rendering uniform the flow of the supplied gas in the space 23 and its preferred ratio of axial height to width of the annular clearance of approximately 2:1 there is a gas flow of a laminar nature towards the tip of the cathode 18. As can be seen in FIG. 9, the tip of the cathode 18 tapers under an angle $\alpha$ between 20° and 90°, preferably 60°, so as to keep the flow laminar for as long as possible and to ensure an optimum emission behaviour (tip effect) for the charge carriers terminates in pointed manner.

The laminar gas flow has, in addition to the uniform plasma jet energy and in conjunction with the specific material choice for the cathode 18, the additional advantage that the ionizing discharge between the cathode 18 and the steel edge K of the ski acting as the anode requires no hard square wave pulse and can instead be ignited with a soft sinusoidal pulse. This obviates shielding problems for the plasma head 9 and without interfering with the surrounding electronic components it can e.g. be used in the control of the support structures 10, in the measuring devices, etc. During the stable operating phase of the plasma torch 9 the current intensity is between 20 and 180 A. The power of the energy beam is preferably between 1 and 5 kW, particularly 2 kW per unit 9.

So that the hardened steel edge does not become too hard, so that it would become brittle, in addition to the aforementioned measures for reducing the current intensity and therefore the energy content of the plasma jet, the energy injection through the plasma jet E can be distributed over a larger area of the steel edge K. Besides the virtual expansion through the deflection of the energy beam E during the relative movement to the steel edge K, e.g. with respect to the plasma jet by a not shown electromagnet surrounding the outlet opening 21, the physical cross-section of the beam can also be widened.

Figure 10A:
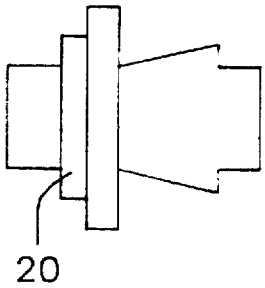
FIG. 10*a* is a side elevational view of a guide piece for the plasma jet.
Figure 10B:
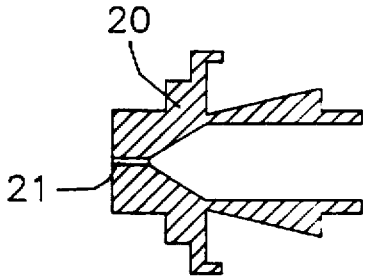
FIG. 10*b* is a longitudinal sectional view of the guide piece for the plasma jet.

For focussing the plasma jet, the guide piece 20 (FIGS. 10a and 10b) of the plasma head 9 is preferably provided with a circular outlet opening 21, preferably with a diameter of 0.5 to 3 mm. The hardness, which is fundamentally independent of the energy density and which can be influenced by means of the relative speed of the plasma jet and the steel edge, remains in the desired range for the specific use of 55 to 70 Rockwell. An optimization can be obtained between the energy injection and the cooling or quenching following the further migration of the impact point of the plasma jet.

Although in the description an explanation has been given in exemplified manner of the hardening of edges already fitted to the ski, with a suitable construction of the devices for bringing about the relative movement between the steel edge to be hardened, specifically by guidance or conveying means matched to the smaller size and rigidity of the steel edge, and the unit for producing the energy beam, it would also be possible to harden the steel edge prior to the assembly with the remaining components of the ski in the manner according to the invention and as indicated in the introduction to the specification.

In all the hitherto described procedures it is advantageously possible that the energy beam E, with respect to the two outer faces of the steel edges K to be hardened, is directed in inclined manner onto the same. Preferably the beam E in the manner shown in FIG. 3 or more clearly in FIG. 4 is directed onto the outer steel edge K to be hardened in a range of approximately 25° about the plane of symmetry and advantageously precisely in the plane of the angular symmetry lines. Thus, the shape of the hardened area within the steel edge can be influenced, so that directly in the extension of the energy beam E the greatest hardening depth is achieved. The hardening depth is smaller the greater the radial spacing with respect to the axis of the energy beam E. The aforementioned effects occur particularly clearly at the plasma jet, whereas they are only obtained to a reduced extent through the limited depth effect of the laser jet.

Figure 11A:
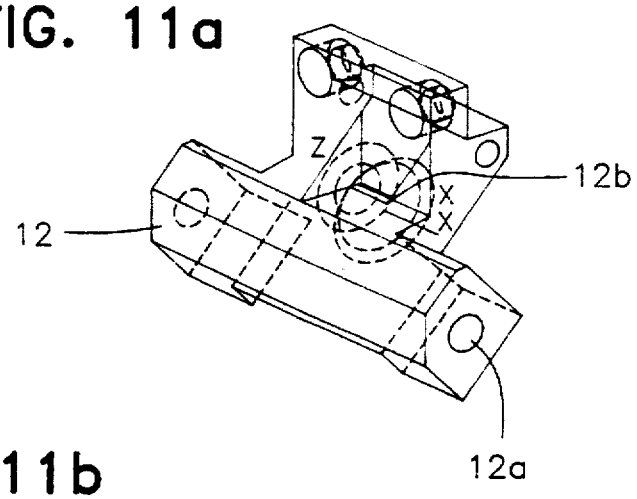
FIG. 11*a* is a perspective view of a guide and cooling shoe for protecting the material of the components of the ski surrounding the edge from excessive heating by the plasma energy beam.
Figure 11B:
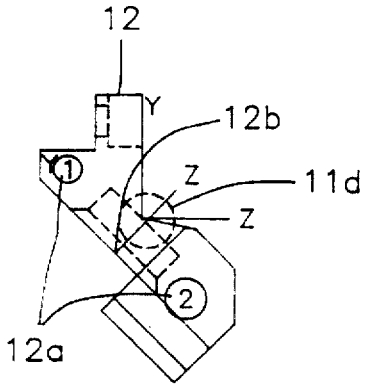
FIG. 11*b* is an end elevational view of the cooling shoe.
Figure 11C:
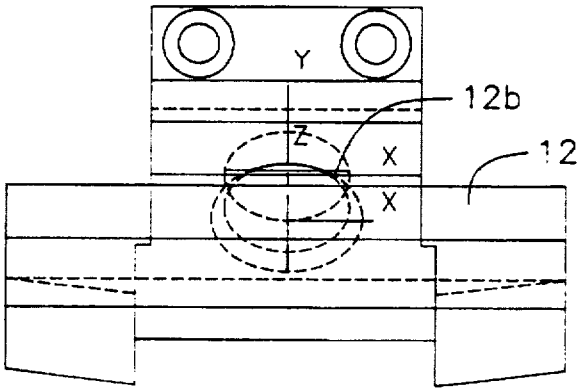
FIG. 11*c* is a side elevational view of the cooling shoe.
Figure 11D:
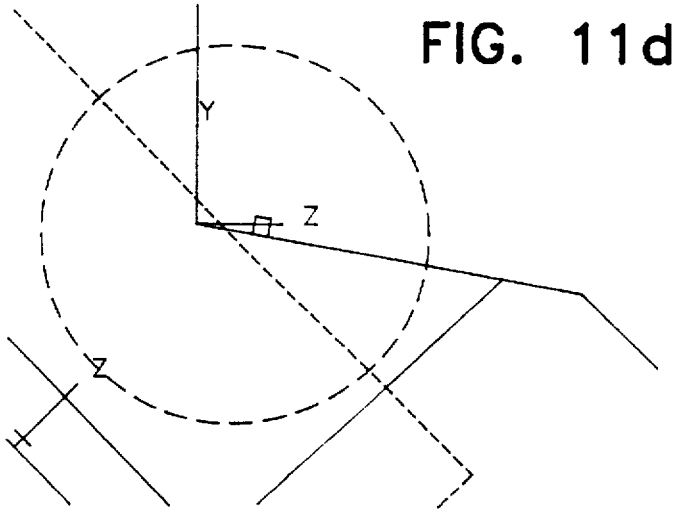
FIG. 11*d* is an enlarged schematic detail of the area indicated at lid in FIG. 11*b*.

FIGS. 11a to 11c show a particularly advantageous embodiment for a cooling shoe 12, which covers in one piece manner the two sides of the ski S facing the plasma head. For the passage of the plasma jet it has a slot-like opening 12b, whose longer diameter is oriented in the direction of the longitudinal axis of the steel edge K. The cooling shoe 12 of FIGS. 11*a* to 11*c* consequently covers the ski S and in this way prevents an impact of the plasma jet on areas which are not to be hardened of the steel edge K or the ski S.

I claim:

1. Method for hardening steel edges of skis that have been already fitted to the ski comprising the steps of producing an electric arc between a cathode and an annular anode of a plasma head, producing a plasma beam by passing a gas flow through said arc and the annular anode of said plasma head, polarizing the steel edge as the anode of said plasma head, rapidly heating the steel edge at least in the vicinity of an outer lower corner by said plasma beam, rapidly cooling the heated steel edge and consequently hardening the steel edge.

2. Method according to claim 1, including the step of moving the plasma head and the steel edge relative to one another in the longitudinal direction of the ski and, at least over a partial area of the length of the steel edge, and supplying the steel edge-plasma head with precisely the same current intensity to provide the plasma beam with precisely constant energy.

3. Method according to claim 1, including the step of moving the plasma head and the steel edge relative to one another in the longitudinal direction of the ski and, at least over a partial area of the length of the steel edge, and supplying a regular alteration of the current intensity to the steel edge-plasma head to provide the plasma head with regularly variable energy.

4. Method according to claim 1, including the step of passing the gas flow and the plasma beam directly simultaneously onto both outer sides of the steel edge and orienting the axis of the plasma beam at an incline onto both outer sides of the steel edge.

5. Method according to claim 4, wherein said incline of the plasma beam is at an angle of approximately 25° to a plane bisecting the steel edge.

6. Method according to claim 1, including the step of cooling the region of impact of the plasma beam to the extent that a transition area between the steel edge and the ski does not exceed the release temperature of an adhesive fixing the steel edge to the ski.

7. Method according to claim 1, including the step of broadening the impact area of the plasma beam in the longitudinal direction of the steel edge by electromagnetic deflection of the plasma beam.

8. Method according to claim 1, including the step of broadening the cross section of the plasma beam in the longitudinal direction of the steel edge.

9. Method according to claim 1, wherein the gas flow in relation to the plasma head cathode is laminar.

10. Method for hardening steel edges of skis or the like, wherein the steel edges have been already fitted to the ski, comprising the steps of producing an electric arc between a cathode and an annular anode of a plasma head, passing a gas flow through said arc and the annular anode of said plasma head, accompanied by the production of a plasma beam, polarizing the steel edge as the anode of said plasma head, rapidly heating the whole steel edge or partially, at least in the vicinity of the edge outwardly bounding the ski outsole, i.e. the outer, lower corner of the steel edge by means of said plasma beam, and rapidly cooling the steel edge again and consequently being hardened.

* * * * *